US007644920B2

(12) United States Patent
Takasaka et al.

(10) Patent No.: US 7,644,920 B2
(45) Date of Patent: Jan. 12, 2010

(54) IMAGE FORMING APPARATUS WITH OFFSET FEED ROLLER FROM SEPARATION PORTION

(75) Inventors: Daisuke Takasaka, Higashiosaka (JP); Koichi Chikumoto, Osaka (JP); Daisuke Shimizu, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 547 days.

(21) Appl. No.: 11/217,314

(22) Filed: Sep. 2, 2005

(65) Prior Publication Data

US 2006/0049573 A1 Mar. 9, 2006

(30) Foreign Application Priority Data

Sep. 9, 2004 (JP) ..... 2004-262556

(51) Int. Cl.
*B65H 9/16* (2006.01)

(52) U.S. Cl. ..... 271/250; 271/121; 271/240

(58) Field of Classification Search ..... 271/121, 271/240, 241, 248, 250, 254
See application file for complete search history.

(56) References Cited

U.S. PATENT DOCUMENTS 5,651,540 A * 7/1997 Watanabe et al. ..... 271/10.12
5,857,671 A * 1/1999 Kato et al. ..... 271/10.11
5,971,390 A * 10/1999 Caspar et al. ..... 271/121
2005/0121848 A1* 6/2005 Kodama et al. ..... 270/58.12
2006/0071401 A1* 4/2006 Chikumoto ..... 271/121

FOREIGN PATENT DOCUMENTS

| | | |
|---|---|---|
| JP | 59-95035 | 6/1984 |
| JP | 06-135569 A | 5/1994 |
| JP | 07-215512 | 8/1995 |
| JP | 09-040199 | 2/1997 |
| JP | 11-100132 A | 4/1999 |
| JP | 2002-503605 A | 2/2002 |
| WO | WO99/41173 | 8/1999 |

* cited by examiner

*Primary Examiner*—Patrick H Mackey
*Assistant Examiner*—Gerald W McClain
(74) *Attorney, Agent, or Firm*—Global IP Counselors, LLP

(57) ABSTRACT

The image forming apparatus includes a chassis, a paper guide, a paper feed roller, and a paper supply portion from which the paper feed roller is configured to supply paper. The paper guide is supported within the chassis and has a base portion and a first separation portion that projects from the base portion. The paper feed roller is rotatably supported by the chassis. The paper supply portion has a guide projection on its first lateral side portion. The widthwise center of the paper feed roller is offset toward the first lateral side relative to the widthwise center of the first separation portion.

12 Claims, 11 Drawing Sheets

IMAGE FORMING APPARATUS WITH OFFSET FEED ROLLER FROM SEPARATION PORTION

BACKGROUND OF THE INVENTION

1. Field of the Invention

The present invention generally relates to an image forming apparatus. More specifically, the present invention relates to an image forming apparatus equipped with a paper feed roller for conveying paper.

2. Background Information

A thermal transfer printer as an example of known image forming apparatuses. The structure of a conventional thermal transfer printer will be described through reference to FIGS. 15 to 18.

Such conventional thermal transfer printer is generally equipped with a paper guide, to which a paper cassette is inserted. As shown in FIG. 17, paper 130 can be picked up with a paper feed roller 125 from that paper cassette 108 that inserted in the paper guide 106. As shown in FIG. 16, a middle separator wall 106*a* is provided to the lower paper guide 106, on the center line of the width of the paper feed roller 125, so as to be opposite the paper feed roller 125. Two separator walls 106*b* are also provided to the lower paper guide 106, one on each side of the middle separator wall 106*a*. As shown in FIG. 15, the middle separator wall 106*a* is the same height as the two separator walls 106*b* on the sides.

Also, as shown in FIG. 16, two guide components 108*a* that have a convex, round shape and serve as positional guides during paper feed are provided a predetermined distance apart to the paper cassette 108. The width Wc between the two inner lateral edge components of the paper cassette 108 in the N2 direction of FIG. 16 is set to be greater by X on each side than the width Wp of the paper 130, so that the edges of the paper 130 will not be damaged when the paper 130 is put into the paper cassette 108. Accordingly, there may be times when the paper 130 is placed in the paper cassette 108 in a skewed orientation relative to the paper feed direction (the direction of the arrow C2 in FIG. 16).

As shown in FIG. 17, the thermal transfer printer is further provided with a paper lifting member 109, which is attached to the paper cassette 108 so as to be pivotable about a paper lifting member support shaft 109*a*. A lifting lever 131 is attached so that the paper lifting member 109 will be pressed toward the paper feed roller 125 (upward) by a pressing means (not shown).

Next, the manner in which paper is fed in a conventional thermal transfer printer will be described through reference to FIGS. 17 and 18. During the paper feed operation, as shown in FIG. 17, the paper 130 is conveyed by the paper feed roller 125 in the paper feed direction (the direction of the arrow C2 in FIG. 17). At this time, a thermal head of the thermal transfer printer is pivoted in a direction away from the paper 130 while the paper 130 is being supplied (that is, while printing is not in progress).

When the paper feed roller 125 rotates in the direction the arrow H2 to convey the paper 130 in the paper feed direction, a paper feed force P4 is transmitted to the paper 130 as shown in FIG. 18. The center position of this paper feed force P4 is the center position of the width of the paper feed roller 125. Also, as a result of the paper 130 being conveyed, a load P5 is generated between the paper 130 and the middle separator wall 106*a* and the two separator walls 106*b* on the sides, which are in contact with the paper 130. The center of this load P5 is the center of the width of the separator wall 106*a*. Here, since the middle separator wall 106*a* is provided in the middle of the width of the paper feed roller 125 (or the center of the paper feed force P4), and the two separator walls 106*b* on the sides are provided symmetrically with respect to the middle separator wall 106*a*, the line of action of the paper feed force P4 is the same as the line of action of the load P5. Therefore, no rotational force is generated with respect to the paper 130.

However, as shown in FIG. 18, when the paper 130 is placed in the paper cassette 108 in a skewed orientation relative to the paper feed direction (the direction of the arrow C2 in FIG. 18), the combined force of the paper feed force P4 and the load P5 conveys the paper 130 in the paper feed direction in the skewed orientation.

As a result, when the paper 130 is conveyed in the paper feed direction, it is difficult to convey the paper 130 along the guide components 108*a* of the paper cassette 108. This results in variance in the width direction position of the paper 130 being fed.

In view of the above, it will be apparent to those skilled in the art from this disclosure that there exists a need for an improved image forming apparatus that overcomes the problems of the conventional art. This invention addresses this need in the art as well as other needs, which will become apparent to those skilled in the art from this disclosure.

SUMMARY OF THE INVENTION

It is an object of this invention to provide an image forming apparatus with which variance in the paper feed position during the paper feed operation can be reduced without having to increase the number of required parts.

The image forming apparatus of the first aspect of the present invention includes a chassis; a paper guide supported within the chassis and having a base portion and a first separation portion that projects from the base portion; a paper feed roller that is rotatably supported by the chassis; and a paper supply portion from which the paper feed roller is configured to supply paper. The paper supply portion has a guide projection on its first lateral side portion. A widthwise center of the paper feed roller is offset toward the first lateral side relative to a widthwise center of the first separation portion.

With this construction, as discussed above, the first separation portion is disposed is disposed at a location a specific distance away from the center of the width of the paper feed roller and on the side opposite from the guide projection. Therefore, a rotational force toward the guide projection is imparted to the paper during the paper feed operation. As a result, the first lateral side edge of the paper can be brought into contact with the guide projection, so the paper can be conveyed with the first lateral side edge aligned with the guide projection. As a result, variance in the paper feed position can be reduced. Also, since a rotational force in the direction of the first lateral side can be imparted to the paper merely by adjusting the positional relation between the paper feed roller and the first separation portion, there is no need to separately provide a mechanism for imparting to the paper a rotational force toward the first lateral side. As a result, variance in the paper feed position can be reduced without having to increase the number of parts required. Also, where only one paper feed roller is provided, this also reduces the number of parts required.

In the image forming apparatus in accordance with the second aspect of the present invention, the paper supply portion further includes a paper cassette that is configured to be detachably coupled to the paper guide, the paper cassette having a guide projection on its first lateral side portion.

In the image forming apparatus in accordance with the third aspect of the present invention, the paper cassette further includes a biasing component integrally provided on its second lateral side portion, the biasing component being for biasing a second lateral side edge of the paper toward the first lateral side.

With this constitution, a force in the first lateral side direction is imparted not only by the above-mentioned separation portions, but also by the biasing component. Thus, variance in the paper feed position can be further reduced. Also, since the biasing component is provided integrally to the second inner side surface of the paper cassette, providing the biasing component does not increase the number of parts. This too allows variance in the paper feed position to be reduced without having to increase the number of required parts.

In the image forming apparatus in accordance with the fourth aspect of the present invention, the paper guide further has a second separation portion that projects from the base portion and is disposed at least partially on the first lateral side of the first separation portion, the first separation portion protruding further upward from the second separation portion.

With this constitution, since the plurality of second separation portions are further provided, the paper can be easily separated. Also, since the first separation portions protrudes further upward from the plurality of second separation portions, the paper can be prevented from coming into contact with the second separation portions after the paper is picked up. As a result, a rotational force in the direction of the reference components can be imparted to the paper merely by adjusting the positional relation between the paper feed roller and the first separation portions after the paper is picked up.

In the image forming apparatus in accordance with the fifth aspect of the present invention, the second separation portion has one second separation component disposed on the first lateral side of the first separation portion, and another second separation component disposed on a second lateral side, which is opposite the first lateral side, of the first separation portion, the two second separation components being substantially symmetrical with respect to the widthwise center of the first separation portion.

In the image forming apparatus in accordance with the sixth aspect of the present invention, the guide projection has a convex, round shape.

With this constitution, the contact area between the guide projection and the first lateral edge of the paper can be small. Therefore, it is possible to reduce the frictional resistance generated between the guide projection and the first lateral side edge of the paper. This allows the drive force of the motor serving as the drive source for the paper feed roller to be reduced, so the motor can be made more compact.

In the image forming apparatus in accordance with the seventh aspect of the present invention, the paper supply portion has a plurality of guide projections on its first lateral side portion.

In the image forming apparatus in accordance with the eighth aspect of the present invention, the biasing component is unitarily provided on the second lateral side portion of the paper cassette.

In the image forming apparatus in accordance with the ninth aspect of the present invention, the paper supply portion includes a paper cassette that is configured to be detachably coupled to the paper guide and a cover for the paper cassette, the paper cassette having a guide projection on its first lateral side portion, and the cover has an engagement projection that is configured to engage the biasing component when the cover is placed on the paper cassette, such that the biasing component is bent toward the first lateral side.

In the image forming apparatus in accordance with the tenth aspect of the present invention, the first separation portion has at least two first separation components, the widthwise center of the paper feed roller being offset toward the first lateral side relative to the widthwise center of the at least two first separation components.

The image forming apparatus in accordance with the eleventh aspect of the present invention further includes a thermal head pivotably supported in the chassis; and a platen roller rotatably supported in the chassis opposite the thermal head, the thermal head being configured to press the paper against the platen roller to perform printing.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Embodiments of the present invention will now be described through reference to the drawings.

Figure 1:
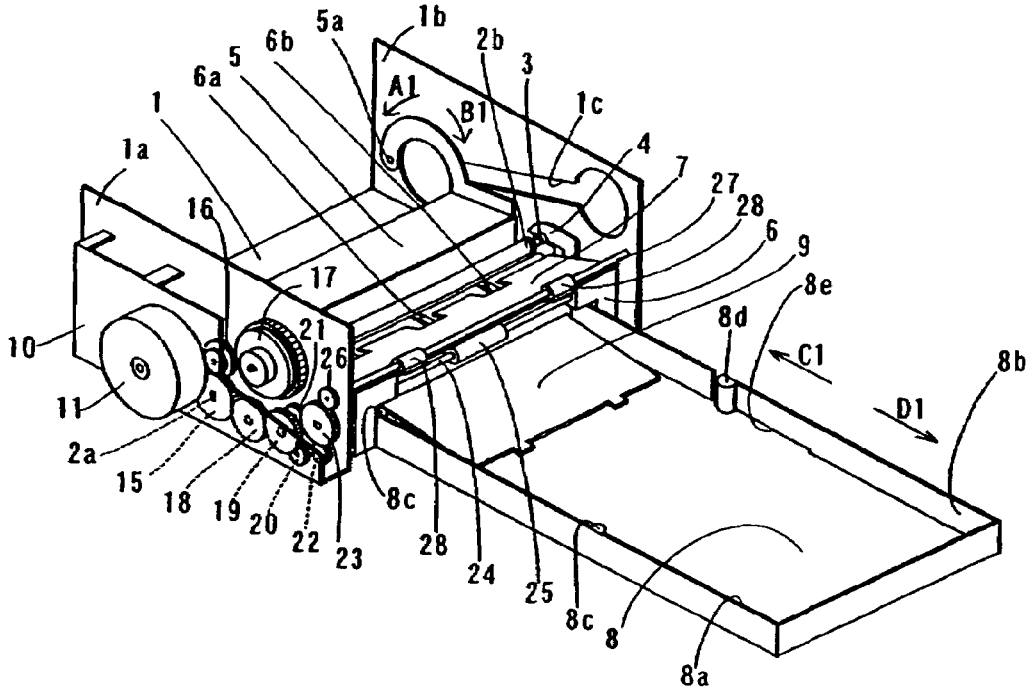
FIG. 1 is an oblique view of the overall structure of a thermal transfer printer pertaining to a first embodiment of the present invention.
Figure 2:
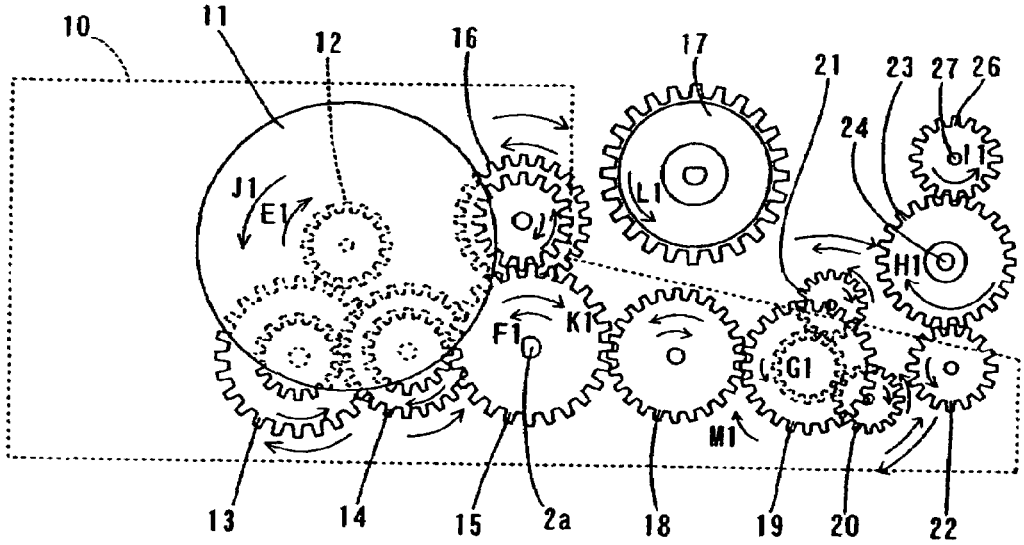
FIG. 2 is a schematic view of the motor and gears of the thermal transfer printer pertaining to the first embodiment shown in FIG. 1.
Figure 3:
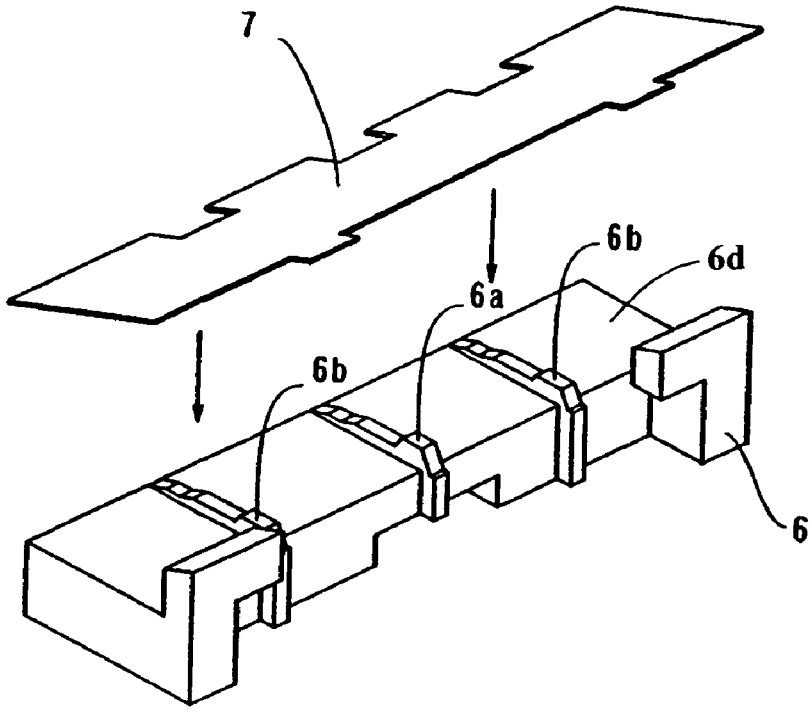
FIG. 3 is an exploded oblique view of the attachment structure of the upper paper guide and the lower paper guide in the thermal transfer printer pertaining to the first embodiment shown in FIG. 1.
Figure 4:
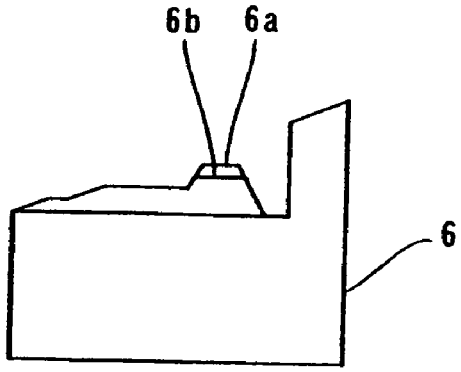
FIG. 4 is a side view of the lower paper guide in the thermal transfer printer pertaining to the first embodiment shown in FIG. 1.

FIG. 1 is an oblique view of the overall structure of a thermal transfer printer pertaining to an embodiment of the present invention. FIG. 2 is a front view of the motor and gears of the thermal transfer printer pertaining to the embodiment shown in FIG. 1. FIG. 3 is an exploded oblique view of the attachment structure of an upper paper guide and lower paper guide in the thermal transfer printer pertaining to the embodiment shown in FIG. 1. FIGS. 4 to 10 are diagrams illustrating the detailed structure of the thermal transfer printer pertaining to the embodiment shown in FIG. 1. The structure of the thermal transfer printer pertaining to an embodiment of the present invention will be described through reference to FIGS. 1 to 10. In this embodiment, a thermal transfer printer will be described as an example of the image forming apparatus of the present invention.

As shown in FIGS. 1 and 2, the thermal transfer printer pertaining to an embodiment of the present invention includes a metal chassis 1, a metal press roller 2*b* that is in contact with a feed roller 2*a* at a specific pressing force, a plastic press roller bearing 3 that rotatably supports the press roller 2*b*, a metal bearing support plate 4 that supports the press roller bearing 3, a thermal head 5 for performing printing, a lower paper guide 6, an upper paper guide 7 attached to the lower paper guide 6, a paper cassette 8 for holding paper, a paper lifting member 9, a motor bracket 10 attached to one side surface 1*a* of the chassis 1, a motor 11 attached to the motor bracket 10, a motor gear 12 (see FIG. 2) attached to the motor 11, intermediate gears 13 and 14, a feed roller gear 15, a pivotable pivot gear 16, an ink sheet take-up gear 17, intermediate gears 18 and 19, pivotable pivot gears 20 and 21, an intermediate gear 22, a paper feed roller shaft gear 23, a paper feed roller shaft 24 (see FIG. 1) that rotates along with the paper feed roller shaft gear 23, a rubber paper feed roller 25 attached to the paper feed roller shaft 24, a paper discharge roller shaft gear 26, a paper discharge roller shaft 27 that rotates along with the paper discharge roller shaft gear 26, and rubber paper discharge rollers 28 attached to the paper discharge roller shaft 27.

Figure 5:
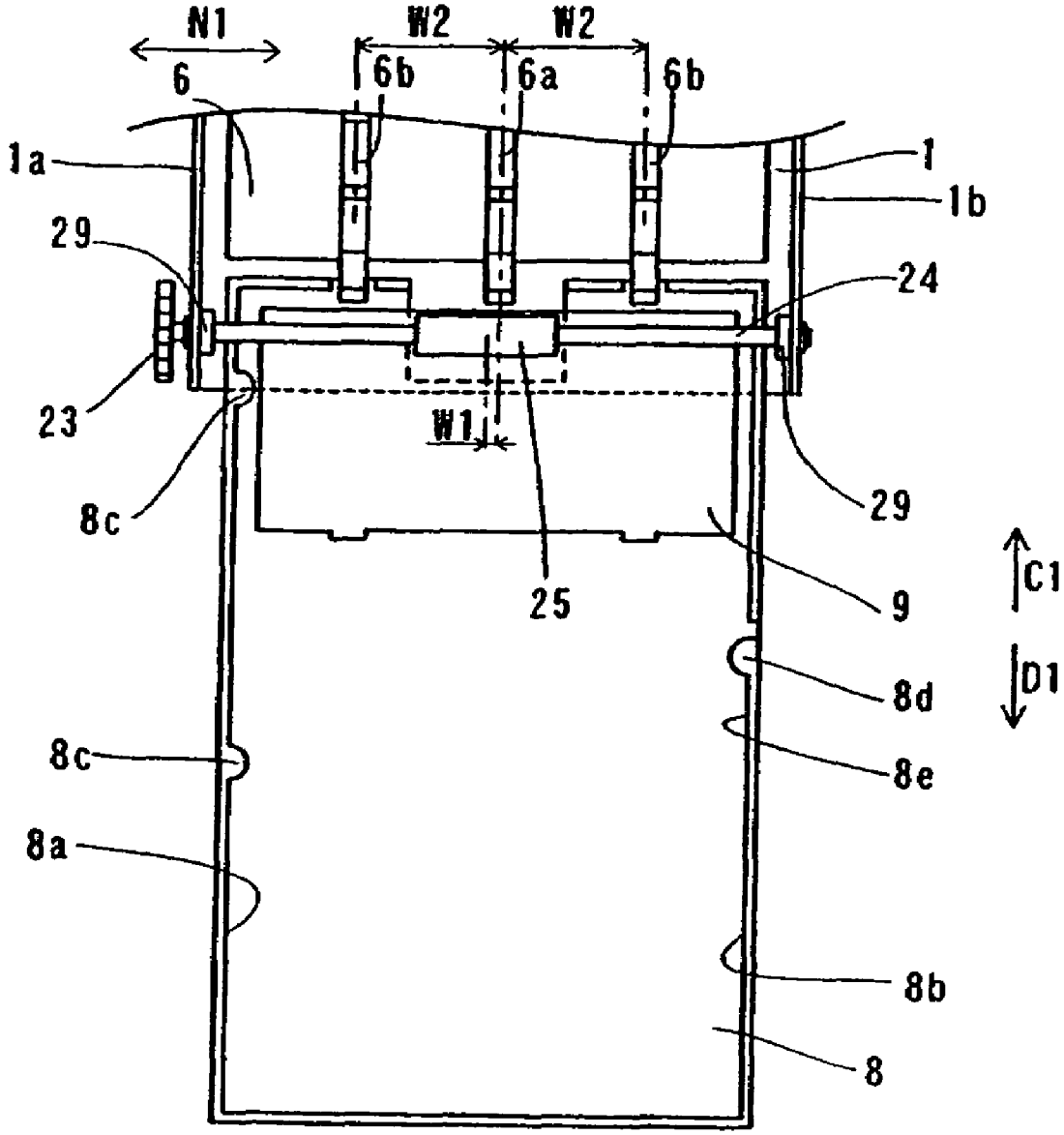
FIG. 5 is a plan view of the thermal transfer printer pertaining to the first embodiment shown in FIG. 1.

As shown in FIG. 1, the chassis 1 is formed in a rectangular U-shape that has one side surface 1*a* and another side surface 1*b*. An ink sheet case insertion hole Ic through which an ink sheet case (not shown) is inserted is provided to the chassis 1. The thermal head 5 is designed to be pivotable around a support shaft 5*a* in the directions A1 and B1 in FIG. 1. The two ends of the paper feed roller shaft 24 are rotatably supported by a pair of paper feed roller bearings 29 attached to the side surfaces 1*a* and 1*b* of the chassis 1 as shown in FIG. 5.

As shown in FIG. 3, with this embodiment, the lower paper guide 6 has a base portion 6*d*, a middle separator wall (an example of the first separation portion) 6*a*, and two lateral separator walls (an example of the second separation portion) 6*b*. The middle separator wall 6*a* and the lateral separator walls 6*b* are provided on the base portion 6*d* so as to project upward. The middle separation wall 6*a* is provided a position shifted away from the widthwise center of the paper feed roller 25 (the center of the paper feed force) by a specific distance W1 on the side opposite from the guide components 8*c*. Also, two lateral separator walls 6*b* are provided on either side of the center of the width of the separator wall 6*a* at a distance W2. Specifically, the two lateral separator walls 6*b* are disposed symmetrically with respect to the separator wall 6*a*. Furthermore, as shown in FIG. 4*a*, the middle separator wall 6*a* protrudes farther upward than the two lateral separator walls 6*b*. That is, the middle separator wall 6*a* is taller than the lateral separator walls 6*b*. The separator wall 6*a* is an example of the "first separation component" of the present invention, and the separator walls 6*b* are an example of the "second separation components" of the present invention.

Figure 6:
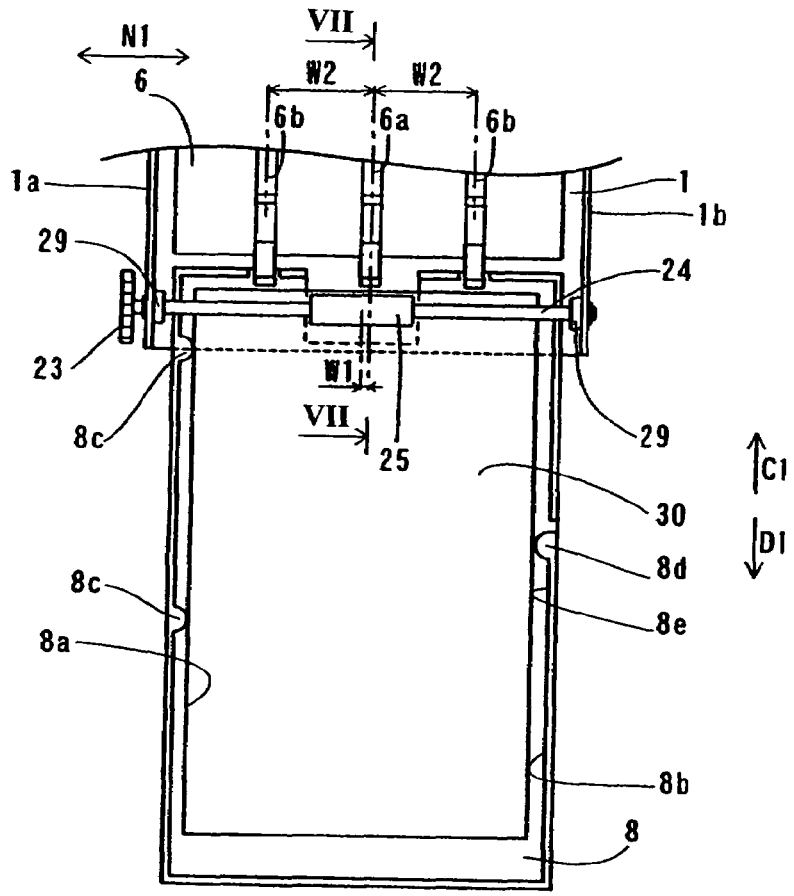
FIG. 6 is a plan view illustrating the operation of the thermal transfer printer pertaining to the first embodiment shown in FIG. 1.

As shown in FIG. 6, in this embodiment, the paper cassette 8 has an inner side surface 8*a* and an inner side surface 8*b*. Two guide components 8*c* that have a convex, round shape and serve as a positional guide during the feeding of paper 30 are provided a specific distance apart to the inner side surface 8*a*. A resin-made biasing component 8*d* that is elastically deformable in the direction of the arrow N1 in FIG. 6 and is used for biasing the lateral edge of the paper 30 toward the guide components 8*c* is unitarily provided to the inner side surface 8*b* of the plastic paper cassette 8. The distal end of this biasing component 8*d* has a convex, round shape.

Furthermore, as shown in FIG. 1, a cut-out 8*e* is provided between the bottom of the paper cassette 8 and the bottom of the inner side surface 8*b* where the biasing component 8*d* is provided. Also, as shown in FIG. 6, the width-direction distance between the distal end of the biasing component 8*d* and the distal ends of the opposing guide components 8*c* is set to be the same as the width of the paper 30. This allows the paper 30 to be held snugly in the paper cassette 8.

Figure 7:
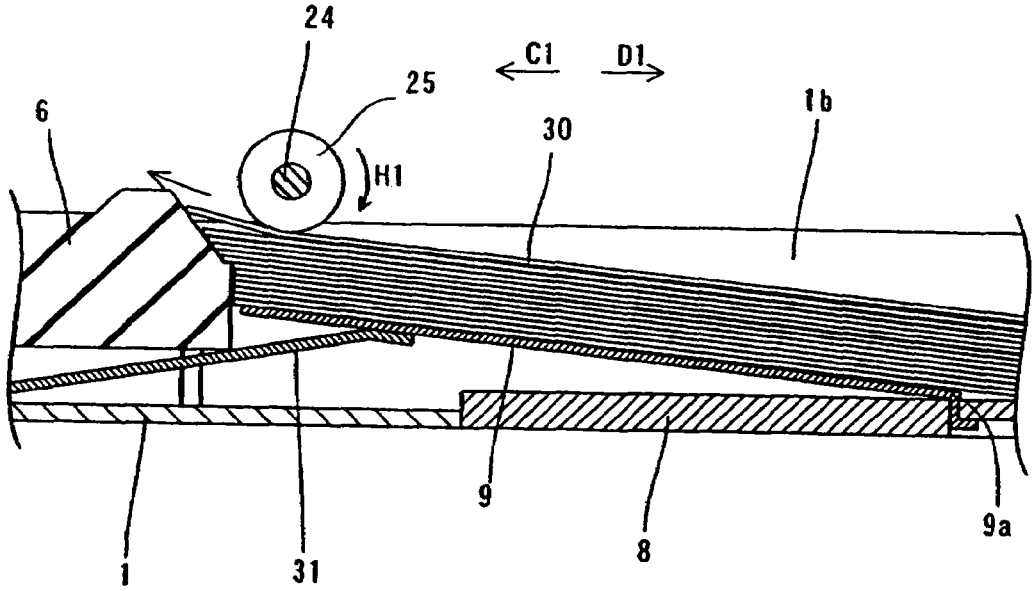
FIG. 7 is a partial cross sectional view of the thermal transfer printer pertaining to the first embodiment viewed along the VII-VII line in FIG. 6.
Figure 8:
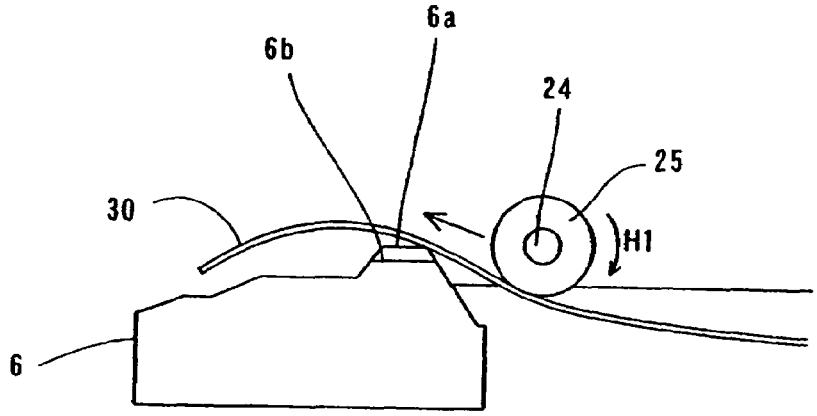
FIG. 8 is a schematic side view illustrating the operation of the thermal transfer printer pertaining to the first embodiment shown in FIG. 1.

As shown in FIG. 7, the paper lifting member 9 is attached to the paper cassette 8 so as to be pivotable around a paper lifting member support shaft 9*a*. A lifting lever 31 is attached so that the paper lifting member 9 will be pressed toward the paper feed roller 25 (upward) by a pressing means (not shown). As shown in FIG. 2, the motor 11 functions as the drive source for the feed roller gear 15, the ink sheet take-up gear 17, the paper feed roller shaft gear 23, and the paper discharge roller shaft gear 26.

Next, the manner in which paper 30 is fed in the thermal transfer printer pertaining to this embodiment will be described through reference to FIGS. 1 and 2. During the paper feed operation, first, as shown in FIG. 2, the motor 11 drives the motor gear 12 attached to the motor 11 to rotate in the direction of the arrow E1. Accordingly, the feed roller gear 15 is rotated via the intermediate gears 13 and 14 in the direction of the arrow F1. As a result, the feed roller 2*a* rotates in the direction of the arrow F1 in FIG. 2. At this point the pivotable pivot gear 16 is not meshed with the ink sheet take-up gear 17, and therefore the ink sheet take-up gear 17 does not rotate.

As the feed roller gear 15 rotates in the direction of the arrow F1, the intermediate gear 19 rotates in the direction of the arrow G1 via the intermediate gear 18. At this point, the pivotable pivot gear 20 meshes with the intermediate gear 22. Therefore, the rotation of the intermediate gear 19 in the direction of the arrow G1 causes the paper feed roller shaft gear 23 to rotate in the direction of the arrow H1 via the pivot gear 20 and the intermediate gear 22. As a result, as shown in FIG. 7, the paper 30 is conveyed by the paper feed roller 25 in the paper feed direction (the direction of the arrow C1 in FIG. 7).

At this time, the drive of a motor (not shown) provided separately from the motor 11 causes the thermal head 5 to pivot in a direction away from the paper 30 (the direction of the arrow Al in FIG. 1) as the paper 30 is being fed (when printing is not in progress).

On the other hand, during the paper discharge (printing) operation, as shown in FIG. 2, the motor 11 drives the motor gear 12 attached to the motor 11 to rotate in the direction of the arrow J1. Accordingly, the feed roller gear 15 rotates in the direction of the arrow K1 in FIG. 2 via the intermediate gears 13 and 14. At this point, the pivotable pivot gear 16 meshes with the ink sheet take-up gear 17 and rotates the ink sheet take-up gear 17 in the direction of the arrow L1 in FIG. 2. As a result, an ink sheet take-up member (not shown) for taking up an ink sheet (not shown) is rotated.

Also, the drive of the motor (not shown) provided separately from the motor 11 causes the thermal head 5 to pivot in the direction of the arrow B1 shown in FIG. 1 to press on the ink sheet (not shown) and the paper 30, as shown in FIG. 1. This results in printing on the paper 30. Also, the rotation of the feed roller gear 15 in the direction of the arrow K1 causes the feed roller 2*a* to rotate in the direction of the arrow K1, and the intermediate gear 19 to rotate via the intermediate gear 18 in the direction of the arrow M1.

At this point, the pivotable pivot gear 21 is meshed with the paper feed roller shaft gear 23. Therefore, the rotation of the intermediate gear 19 in the direction of the arrow M1 causes the paper feed roller shaft gear 23 to rotate via the pivot gear 21 in the direction of the arrow M1, and the paper discharge roller shaft gear 26 to rotate in the direction of the arrow I1. Accordingly, the paper discharge rollers 28 convey the paper 30 in the paper discharge direction (printing direction), which is the direction of the arrow D1 shown in FIG. 1.

Figure 9:
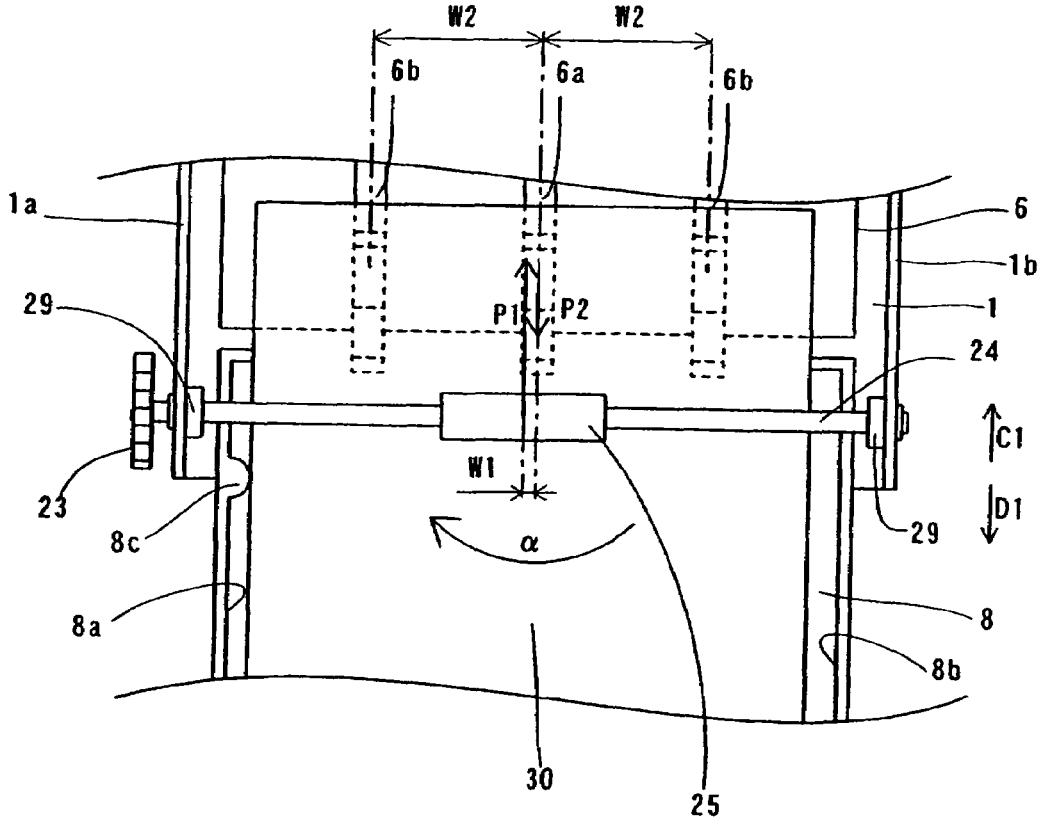
FIG. 9 is a partial plan view illustrating the operation of the thermal transfer printer pertaining to the first embodiment shown in FIG. 1.

In this embodiment, when the paper feed roller shaft gear 23 rotates in the direction of the arrow H1 (see FIG. 2), the paper feed roller 25 rotates to convey the paper 30 in the paper feed direction, which is the direction the arrow C1 in FIGS. 1 and 7. Accordingly, the paper feed force P1 shown in FIG. 9 is imparted to the paper 30. The center position of this paper feed force P1 is the widthwise center of the paper feed roller 25.

Also, as a result of the paper 30 being conveyed, a load P2 is generated between the paper 30 and the separator wall 6*a* (see FIG. 8), which protrudes upward so as to be in contact with the paper 30. Since the middle separator wall 6*a* is formed so that it protrudes farther upward than the lateral separator walls 6*b*, only the separator wall 6*a* is in contact with the paper 30 after the paper is picked up, with the two lateral separator walls 6*b* not touching the paper 30. Therefore, when the paper is picked up, the load P2 is generated between the paper 30 and the middle separator wall 6*a*. The center of this load P2 is the widthwise center of the separator wall 6*a*.

Here, the separator wall 6*a* is provided at a position shifted from the widthwise center of the paper feed roller 25 (the center of the paper feed force P1) by a specific distance W1 on the side opposite from the guide components 8*c*. Therefore, the left side lateral edge of the paper 30 as seen in FIG. 9 is subjected to a rotational force in the direction of the arrow a in FIG. 9, toward the guide components 8*c* of the paper cassette 8. As a result, the left side lateral edge of the paper 30 is pushed toward the guide components 8*c* of the paper cassette 8, and the paper 30 is conveyed in the paper feed direction (the direction of the arrow C1 in FIG. 9) with the left side lateral edge of the paper 30 being aligned with the guide components 8*c*.

Figure 10:
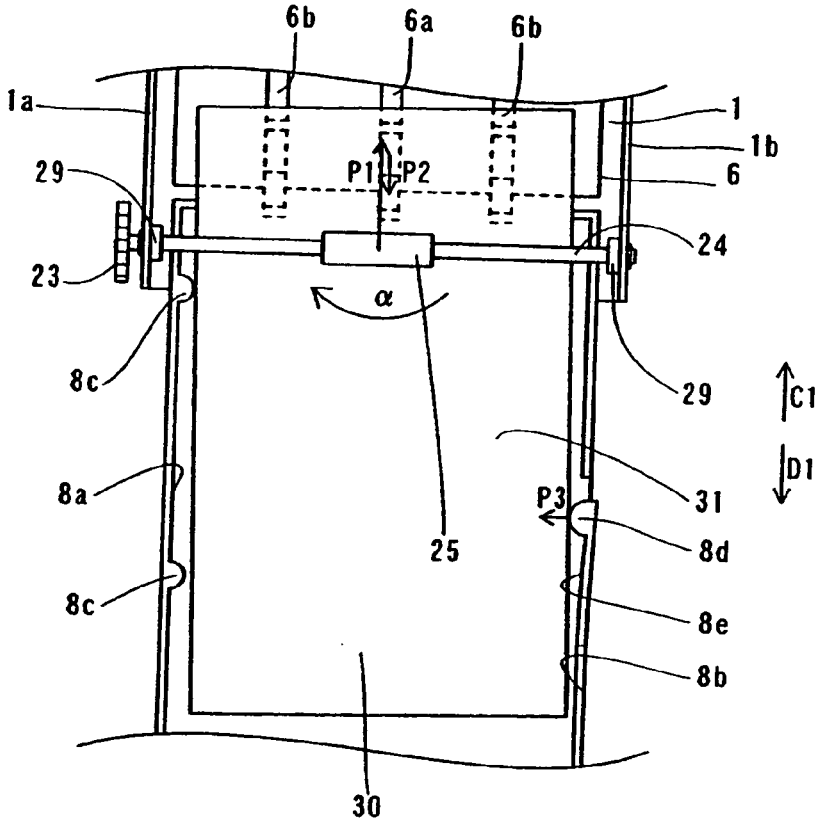
FIG. 10 is a plan view illustrating the operation of the thermal transfer printer pertaining to the first embodiment shown in FIG. 1.

More specifically, as shown in FIG. 10, even if the paper 30 is placed in a skewed orientation relative to the paper feed direction (the direction of the arrow C1 in FIG. 10), the biasing force P3 of the biasing component 8*d* and the rotational force in the direction of the arrow a cause the left side lateral edge of the paper 30 to move in the direction toward the guide components 8*c* of the paper cassette 8 while the paper 30 is conveyed in the paper feed direction (the direction of the arrow C1 in FIG. 10). Accordingly, the paper 30 can be conveyed in the paper feed direction (the direction of the arrow C1 in FIG. 10) in a state in which the left side lateral edge of the paper 30 is aligned with the guide components 8*c*.

With this embodiment, as discussed above, since the separator wall 6*a* disposed opposite the paper feed roller 25 is disposed at a position shifted from the widthwise center of the paper feed roller 25 by a specific distance W1 on the side opposite from the guide components 8*c*, a rotational force in the direction of the arrow a (toward the guide components 8*c*) is imparted to the paper 30 during the paper feed operation. As a result, the left side lateral edge of the paper 30 can come into contact with the guide components 8*c*, so the paper can be conveyed in a state in which the left side lateral edge of the paper 30 is aligned with the guide components 8*c*. This allows the variance in the feed position of the paper 30 to be reduced.

In this structure, since a rotational force in the direction of the arrow $\alpha$ (toward the guide components 8*c*) is imparted to the paper 30 merely by adjusting the positional relation between the paper feed roller 25 and the first separation component 6*a*, which is disposed across from the paper feed roller 25, there is no need to separately provide a mechanism for imparting a rotational force in the direction of the guide components 8*c* to the paper. As a result, variance in the feed position of the paper 30 can be reduced without having to increase the number of parts. Also, since only one paper feed roller 25 is provided, this also allows the number of requisite parts to be reduced.

Also, with this embodiment, because the biasing component 8*d* for biasing the right side lateral edge of the paper 30 toward the guide components 8*c* is unitarily provided to the inner side of the right side surface 8*b* of the paper cassette 8, a force in the direction toward the guide components 8*c* is imparted to the paper 30 not only by the above-mentioned separation component 6*a*, but also by the biasing component 8*d*. Therefore, variance in the feed position of the paper 30 can be further reduced. Also, since the biasing component 8*d* is provided unitarily to the second inner side surface 8*b* of the paper cassette 8, the biasing component 8*d* does not increase the number of parts. This too allows variance in the feed position of the paper 30 to be reduced without having to increase the number of requisite parts.

Also, with this embodiment, since there are further provided the two separator walls 6*b* disposed symmetrically on either side with respect to the widthwise center of the middle separator wall 6*a*, the paper 30 can be picked up easily by the three separator walls 6*a* and 6*b*. Also, since the separator wall 6*a* protrudes farther upward than the separator walls 6*b*, the paper 30 can be prevented from coming into contact with the separator walls 6*b* after the paper 30 is picked up. As a result, a rotational force in the direction of the arrow $\alpha$ (toward the guide components 8*c*) can be imparted to the paper 30 after the paper is picked up merely from the positional relation between the paper feed roller 25 and the separator wall 6*a*.

Also, with this embodiment, since the portion of the guide components 8*c* that comes into contact with the paper 30 has a convex, round shape, the contact area between the guide components 8*c* and the left side lateral edge of the paper 30 is smaller than the contact area of the guide components which come into contact with the paper with a flat surface. Therefore, it is possible to reduce the frictional resistance generated between the guide components 8*c* and the left side lateral edge of the paper 30. This allows the drive force of the motor 11, which is the drive source for the paper feed roller 25, to be reduced. Therefore, the motor 11 can be more compact.

The embodiments disclosed herein are examples in all respects, and should not be construed as being limiting in nature. The scope of the present invention is given by the Claims, and not by the above description of the embodiments, and furthermore the present invention encompasses all modifications that are within the equivalent meaning and scope as the Claims.

For instance, in the above embodiments, a thermal transfer printer is used as an example of an image forming apparatus, but the present invention is not limited to such construction. The present invention can also be applied to an image forming apparatus other than a thermal transfer printer, such as an inkjet printer or a laser printer, as long as such image forming apparatus has a separation component for picking up paper.

Also, in the above embodiments, one middle separator wall and two lateral separator walls that are shorter than the middle separator wall, all of which perform paper separation, are provided. However, the present invention is not limited to such construction. For instance, only the middle separator wall may be provided. Also, three or more lateral separator walls that are shorter than the middle separator wall may also be provided.

Figure 11:
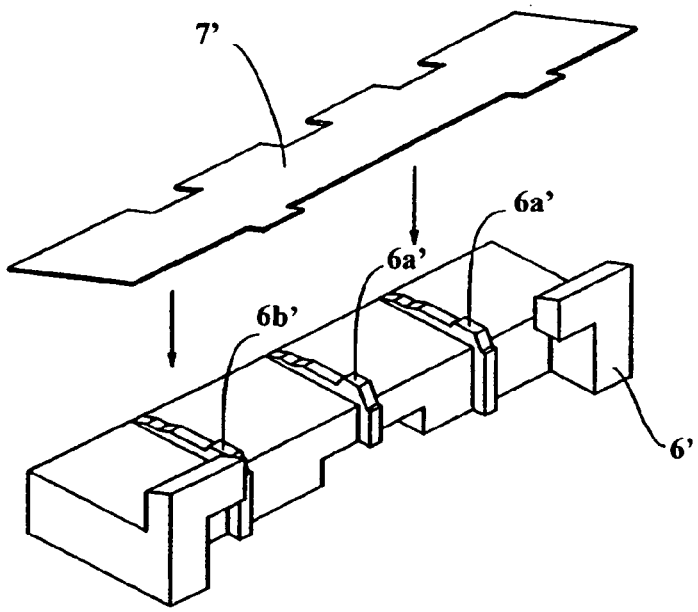
FIG. 11 is an exploded oblique view of the attachment structure of the upper paper guide and the lower paper guide in the thermal transfer printer pertaining to an alternate embodiment.
Figure 12:
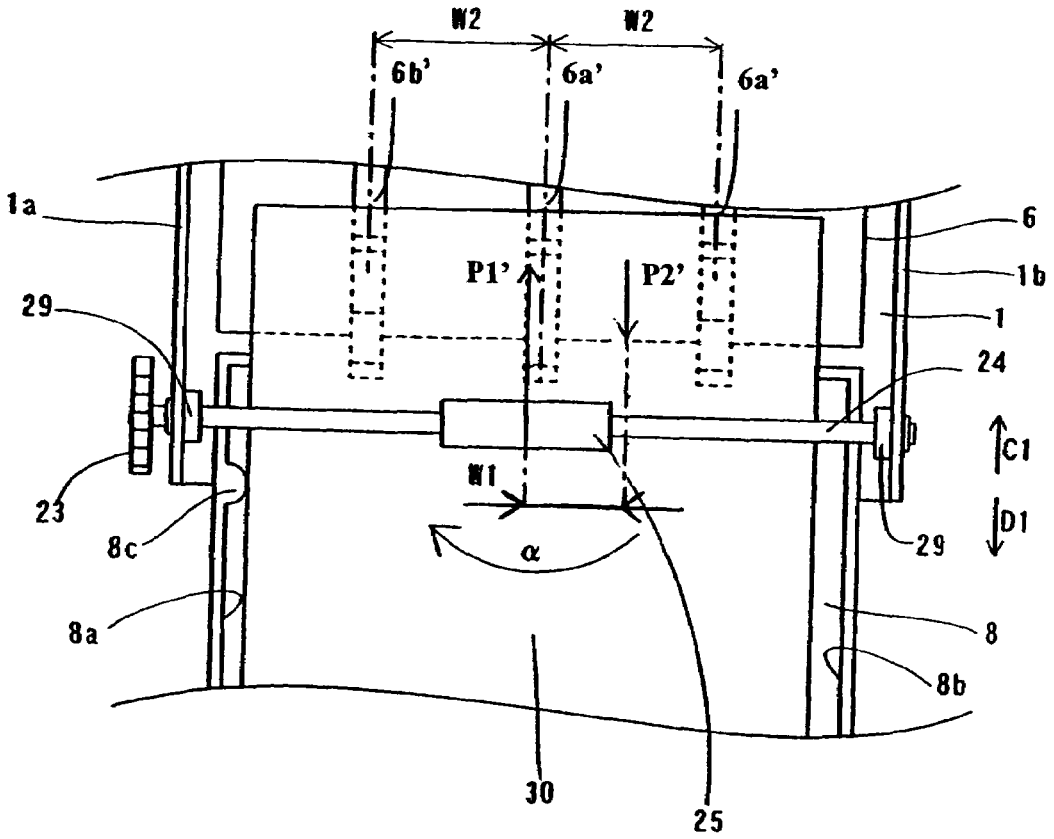
FIG. 12 is a partial plan view illustrating the operation of the thermal transfer printer pertaining to the alternate embodiment shown in FIG. 11.

Furthermore, there may be more than one separator walls that are taller than other separator wall. For example, in the example shown in FIGS. 11 and 12, there are two separator walls 6*a*' (another example of the first separation portion) that are taller than the separator wall 6*b*' (another example of the second separation portion). In this case, the paper feed force P1' is imparted to the paper 30' at the widthwise center of the paper feed roller 25', as shown in FIG. 12. A load P2' is generated between the paper 30' and the separators walls 6*a*'. The position of the load P2' is between the two separator walls 6*a*'. Accordingly, the paper feed force P1' and the load P2' create a rotational force in the direction of the arrow α, which shifts the paper 30' in the direction toward the guide components 8*c*.

Also, in the above embodiments, the portion of the guide components that comes into contact with the paper has a convex, round shape. However, the present invention is not limited to such construction. The portion of the reference components that comes into contact with the paper may have any other shape.

Also, in the above embodiments, a biasing component for biasing the paper toward the guide components is provided to the inner side surface of the paper cassette on the side opposite from the guide components. However, the present invention is not limited to such construction. An image forming apparatus of the present invention does not have to be provided with a biasing component.

Figure 13:
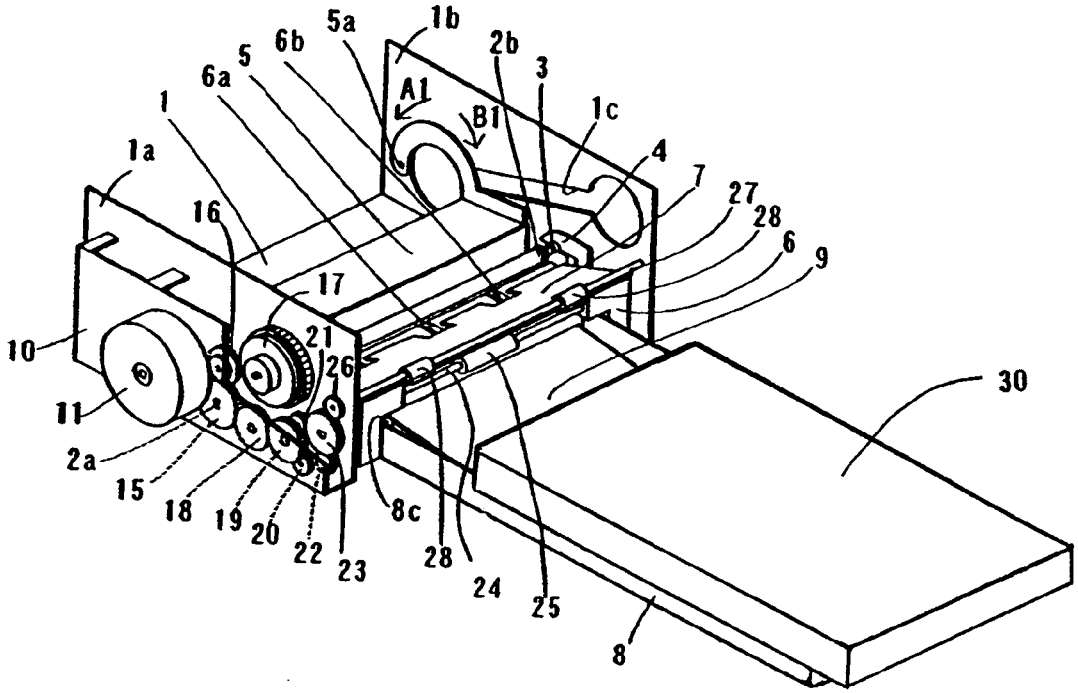
FIG. 13 is an oblique view of the overall structure of a thermal transfer printer pertaining to still another embodiment.
Figure 14:
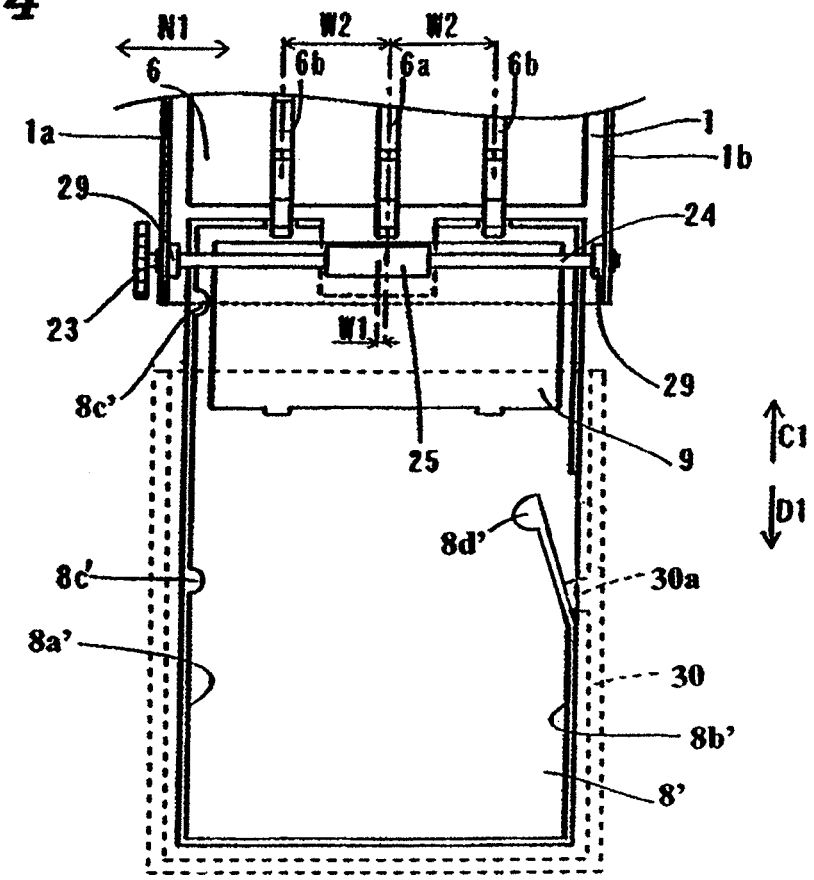
FIG. 14 is a plan view of the thermal transfer printer pertaining to the alternate embodiment shown in FIG. 13.
Figure 15:
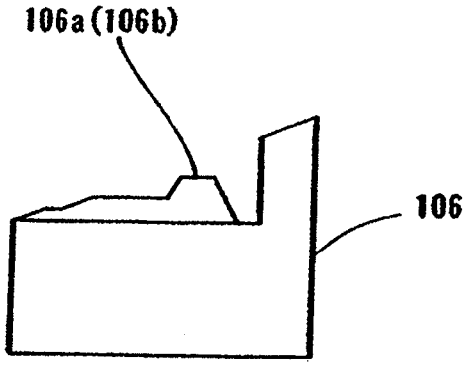
Figure 15 PRIOR ART
FIG. 15 is a side view of the lower paper guide in a conventional thermal transfer printer.
Figure 16:
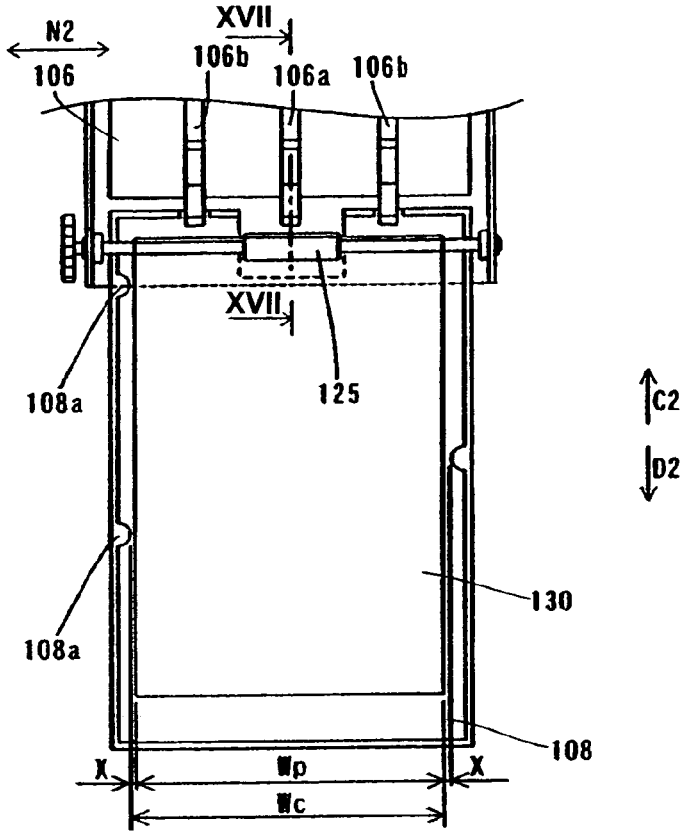
FIG. 16 is a plan view illustrating the operation of the conventional thermal transfer printer shown in FIG. 15.
Figure 17:
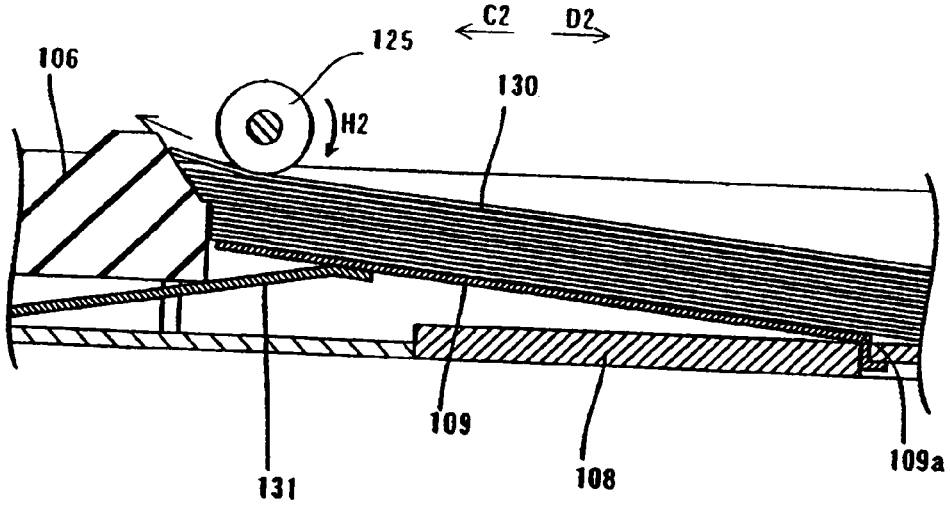
Figure 17 PRIOR ART
FIG. 17 is a cross sectional view of the conventional thermal transfer printer, viewed along the XVII-XVII line in FIG. 16.
Figure 18:
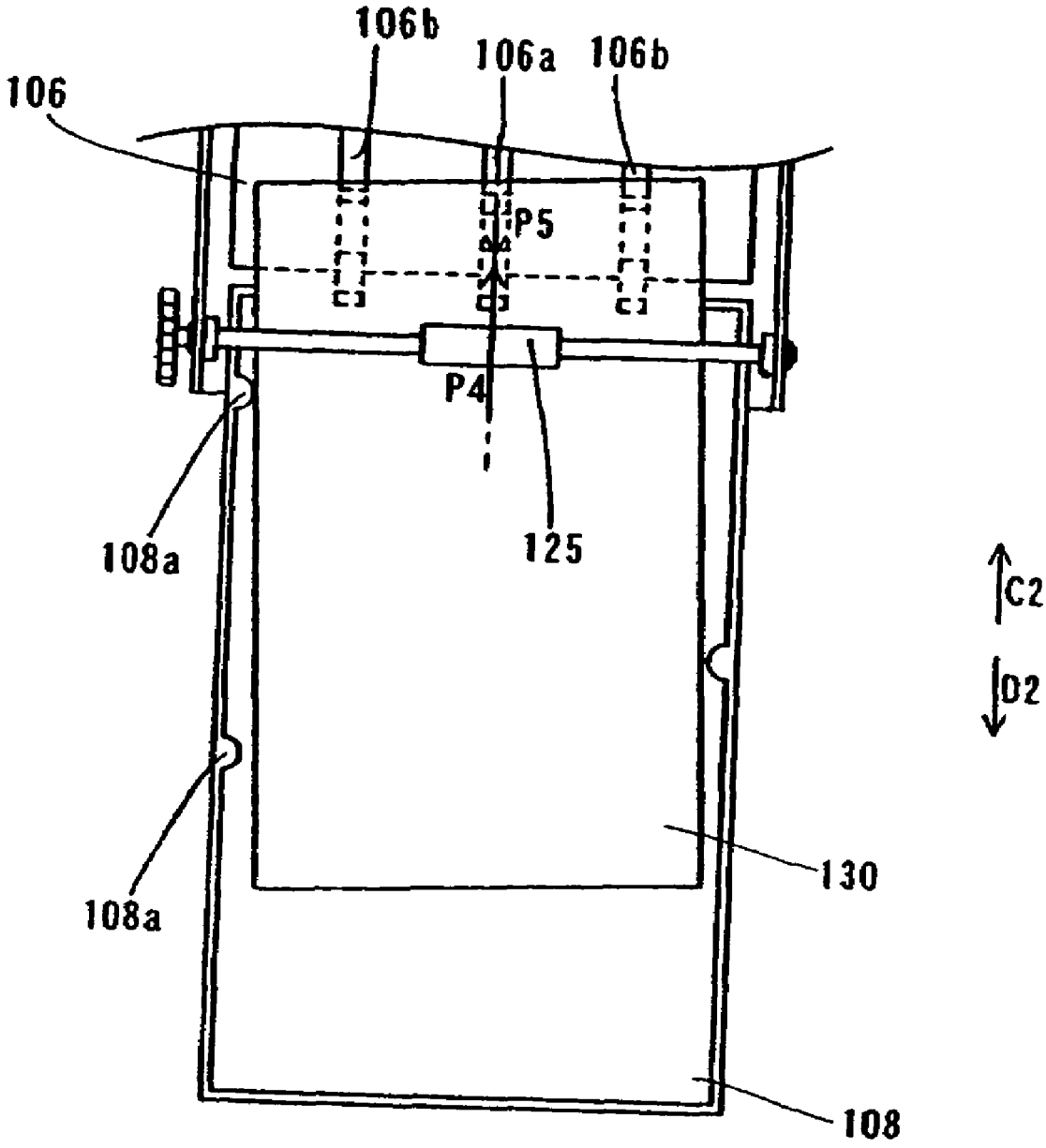
Figure 18 PRIOR ART
FIG. 18 is a plan view illustrating the operation of the conventional thermal transfer printer shown in FIG. 15.

Furthermore, the biasing component may be structured so as to impart biasing force to the paper when a paper cassette is covered with a cover as shown in FIG. 13. As shown in FIG. 14, such cover 30 has an engagement projection 30*a* in its inner side, which engages a base portion of the biasing component 8*d*'. Accordingly, the biasing component 8*d*' is bent toward the guide components 8*c*'. Therefore, the biasing component 8*d*' imparts biasing force to the paper even further.

Although the paper cassette 8 is shown as an example of the paper supply portion in the above embodiment, the present invention is applicable to any other type of paper supply portion, such as a paper supply inlet integrally formed with the chassis.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus, comprising:

a chassis;

a paper guide supported within the chassis and having a base portion and a first separation portion that projects from the base portion;

a paper feed roller that is rotatably supported by the chassis about a rotational axis of the paper feed roller; and a paper supply portion from which the paper feed roller supplies paper, the paper supply portion having a first lateral side portion and a guide projection on the first lateral side portion, a widthwise center of the paper feed roller being offset toward the first lateral side portion relative to a widthwise center of the first separation portion with the paper feed roller being arranged to intersect a widthwise center of the paper, and the first separation portion of the paper guide being formed at a location aligned with the paper feed roller as viewed from a paper feed direction that is perpendicular to the rotational axis of the paper feed roller.

2. The image forming apparatus according to claim 1, wherein the paper supply portion includes a paper cassette that is detachably coupled to the paper guide, the paper cassette having the guide projection on the first lateral side portion.

3. The image forming apparatus according to claim 2, wherein the paper cassette further includes a second lateral side portion and a biasing component integrally provided on the second lateral side portion, the biasing component being for biasing a second lateral side edge of the paper toward the first lateral side portion.

4. The image forming apparatus according to claim 3, wherein the paper supply portion has a pair of guide projections on the first lateral side portion, the biasing component of the paper cassette being formed at a location aligned with a location between the guide projections as viewed from a direction along the rotational axis of the paper feed roller.

5. The image forming apparatus according to claim 3, wherein the biasing component is unitarily provided on the second lateral side portion of the paper cassette.

6. The image forming apparatus according to claim 3, wherein the paper supply portion includes a paper cassette that is detachably coupled to the paper guide and a cover for the paper cassette, the paper cassette having a first lateral side portion and a guide projection on the first lateral side portion, and the cover has an engagement projection that engages the biasing component when the cover is placed on the paper cassette, such that the biasing component is bent toward the first lateral side portion.

7. The image forming apparatus according to claim 3, wherein the biasing component of the paper cassette further includes a tab portion that extends from the second lateral side portion at a location spaced from a bottom of the paper cassette.

8. The image forming apparatus according to claim 1, wherein the paper guide further has a second separation portion that projects from the base portion and is disposed at least partially on a first lateral side relative to the first separation portion, the first separation portion protruding further upward from the second separation portion.

9. The image forming apparatus according to claim 1, wherein the guide projection has a convex, round shape.

10. The image forming apparatus according to claim 1, wherein the first separation portion has at least two first separation components, the widthwise center of the paper feed roller being offset toward the first lateral side portion relative to the widthwise center of the at least two first separation components.

11. The image forming apparatus according to claim 1, further comprising a thermal head pivotally supported in the chassis, the thermal head pressing the paper to perform printing.

12. An image forming apparatus, comprising:

a chassis;

a paper guide supported within the chassis and having a base portion and a first separation portion that projects from the base portion;

a paper feed roller that is rotatably supported by the chassis about a rotational axis of the paper feed roller; and a paper supply portion from which the paper feed roller supplies paper, the paper supply portion having a first lateral side portion and a guide projection on the first lateral side portion, a widthwise center of the paper feed roller being offset toward the first lateral side portion relative to a widthwise center of the first separation portion with the paper feed roller being arranged to intersect a widthwise center of the paper, the first separation portion of the paper guide being formed at a location aligned with the paper feed roller as viewed from a paper feed direction that is perpendicular to the rotational axis of the paper feed roller, the paper guide further having a second separation portion that projects from the base portion and is disposed at least partially on a first lateral side relative to the first separation portion, the first separation portion protruding further upward from the second separation portion, and the second separation portion having one second separation component disposed on the first lateral side relative to the first separation portion, and another second separation component disposed on a second lateral side, which is opposite the first lateral side relative to the first separation portion, the two second separation components being symmetrical with respect to the widthwise center of the first separation portion such that distances between the first separation portion and the two second separation components in a direction along the rotational axis of the paper feed roller are equal to each other.

* * * * *